US005752149A

United States Patent [19]

Yuza et al.

[11] Patent Number: 5,752,149

[45] Date of Patent: May 12, 1998

[54] IMAGE HEATING APPARATUS USING ENDLESS WEB GUIDED BY A GUIDE HAVING INCLINED SURFACES

[75] Inventors: Akira Yuza; Nobukazu Adachi; Akira Kuroda; Takeshi Sugita, all of Yokohama, Japan

[73] Assignee: Canon Kabushiki Kaisha, Tokyo, Japan

[21] Appl. No.: 630,271

[22] Filed: Apr. 10, 1996

Related U.S. Application Data

[63] Continuation of Ser. No. 77,049, Jun. 16, 1993, abandoned.

[30] Foreign Application Priority Data

Jun. 16, 1992 [JP] Japan ..... 4-156755

[51] Int. Cl.[6] ..... G03G 15/20

[52] U.S. Cl. ..... 399/329

[58] Field of Search ..... 355/282, 285, 355/289, 290; 219/216, 469; 198/806, 840; 474/109, 119, 122, 123, 140; 399/329

[56] References Cited

U.S. PATENT DOCUMENTS

| | | | |
|---|---|---|---|
| 5,027,160 | 6/1991 | Okada et al. | 355/282 |
| 5,091,752 | 2/1992 | Okada | 355/285 |
| 5,148,226 | 9/1992 | Setoriyama et al. | 355/290 |
| 5,181,888 | 1/1993 | Takahashi et al. | 474/123 X |
| 5,196,895 | 3/1993 | Setoriyama et al. | 355/285 |
| 5,210,579 | 5/1993 | Setoriyama et al. | 355/285 |
| 5,235,395 | 8/1993 | Ishiwata | 355/285 |
| 5,241,155 | 8/1993 | Koh et al. | 219/216 |
| 5,257,078 | 10/1993 | Kuroda | 355/290 |
| 5,267,005 | 11/1993 | Yamamoto et al. | 355/290 |

FOREIGN PATENT DOCUMENTS

| | | | |
|---|---|---|---|
| 0025479 | 2/1991 | Japan | 355/290 |
| 0025480 | 2/1991 | Japan | 355/290 |

*Primary Examiner*—Robert Beatty

*Attorney, Agent, or Firm*—Fitzpatrick, Cella, Harper & Scinto

[57] ABSTRACT

An image heating apparatus includes a heater; an endless film loosely trained around the heater; a pressing roller cooperative with the heater to form a nip with the film interposed between the pressing roller and the heater; a driver for driving the pressing roller; a guiding member for guiding an inside surface of the film, and extended along the pressing roller; wherein the guiding member has, at an end portion, a film guiding surface which is inclined relative to an axis of the pressing roller.

10 Claims, 11 Drawing Sheets

IMAGE HEATING APPARATUS USING ENDLESS WEB GUIDED BY A GUIDE HAVING INCLINED SURFACES

This application is a continuation of application Ser. No. 08/077,049 filed Jun. 16, 1993, now abandoned.

FIELD OF THE INVENTION AND RELATED ART

The present invention relates to an image heating apparatus comprising a heater, an endless film trained around the heater and a pressing roller for forming an nip with the heater through the film.

An image heating apparatus has been proposed in U.S. Pat. Nos. 5,149,941 and 5,027,160, for example, which uses a heater and a thin film, so that a warming-up period is significantly reduced or eliminated. Such an image heating apparatus uses a driving roller for driving the film.

U.S. Pat. No. 5,148,226 has proposed a device for driving the film by a pressing roller for forming a nip with the heater.

FIGS. 10, 11 and 12 shows an example of such an apparatus. A fixing film 8 is advanced along a film guide 23 by friction with the pressing roller 9, heater 21 and a transfer sheet P. The driving force is applied to the pressing roller 9 from an unshown motor through a driving gear 22 coaxial with the pressing roller 9. A transfer sheet carrying an unfixed toner image and having been fed from an unshown image forming station is heated and pressed while being passed through the fixing nip. In this process, the toner image is softened, fused, solidified into a permanent fixed image.

However, a film driving force is not uniform in the direction of the width thereof even in the case of a tensionless film heating apparatus. This is because unavoidable manufacturing tolerances of the heater and the pressing roller which form a nip therebetween with the traveling film interposed therebetween, or because a temperature distribution occurs in the direction of the width of the heater.

As will be described hereinafter in conjunction with FIG. 4, a central axis of the fixing film is inclined a degrees with respect to the fixing film supporting surface 10*a* by a certain degree of a peripheral length difference between the fixing film and the fixing film guide. Then, a lateral shift of the film in indefinite direction occurs. When the lateral shift of the film is limited by the flange at a film lateral end, the film is folded, creased or even cracked, depending on the thickness and/or material of the film. As a result, if it is used for an image fixing apparatus, the fixed image will be deteriorated, the fixing film will be improperly advanced, the durability of the fixing apparatus will be decreased, or noise will be produced by limiting the end of the film. These are the problems.

SUMMARY OF THE INVENTION

Accordingly, it is a principal object of the present invention to provide an image heating apparatus in which possible damage to a film due to lateral shift is effectively prevented.

It is another object of the present invention to provide an image heating apparatus in which a film can be properly advanced.

According to an aspect of the present invention, there is provided an image heating apparatus comprising: a heater; an endless film loosely trained around the heater; a pressing roller cooperative with the heater to form a nip therebetween with the film interposed therebetween; driving means for driving the pressing roller; a guiding member for guiding an inside surface of the film, and extended along the pressing roller; wherein the guiding member has, at an end portion, a film guiding surface which is inclined relative to an axis of the pressing roller.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
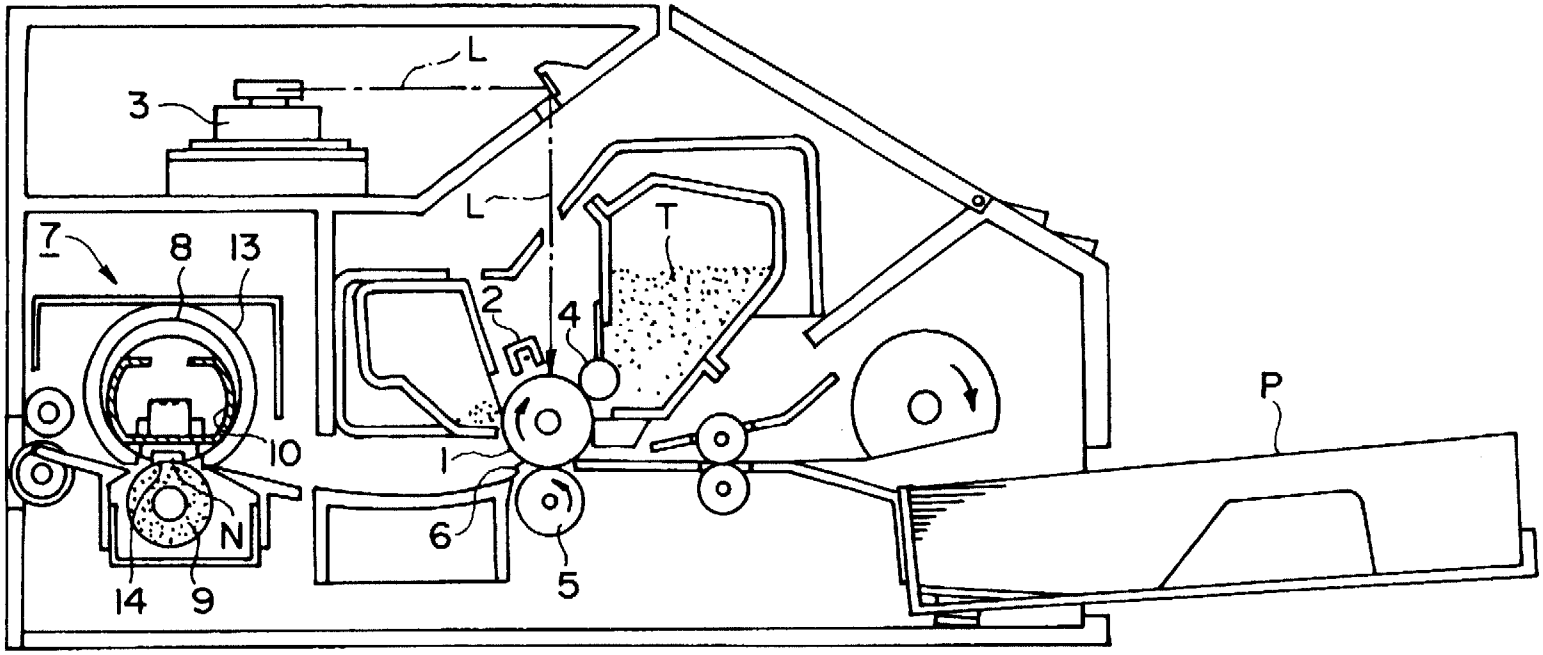
FIG. 1 is a side view of an inside part of an image forming apparatus according to a first embodiment of the present invention.

FIG. 1 Is a side view of a laser beam printer as an image forming apparatus according to a first embodiment of the present invention (fixing apparatus). The image forming apparatus comprises an electrophotographic photosensitive member (drum) rotated at a predetermined peripheral speed. The drum 1, while being rotated, is uniformly charged to a predetermined polarity (positive or negative) by a primary charger 2, and is exposed to a scanning laser beam L through a laser scanner 3, so that an intended electrostatic latent image is formed thereon. The surface of the drum 1 having an electrostatic latent image formed thereon is supplied with toner T by a developing device 4, so that the latent image is visualized into a toner image. Subsequently, the toner image, while passing through a transfer position having a transfer roller 5, is continuously transferred onto a surface of a transfer sheet P having been supplied to between the transfer roller 5 and the drum 1 in the transfer of the image from the drum 1 to the surface of the transfer sheet P, the transfer roller 5 applied to the backside of the transfer sheet the electric charge of the polarity opposite from that of the charge of the toner image. Subsequently, the transfer sheet P is electrically discharged by discharging needles 6 supplied with a voltage having the polarity opposite from that of the transfer roller 5, and is separated from the drum 1 into a heating apparatus 7. In the heating apparatus 7, the toner T on the surface of the transfer sheet P is heated and fused, and fixed into a permanent fixed image on the surface of the transfer sheet P.

Figure 2:
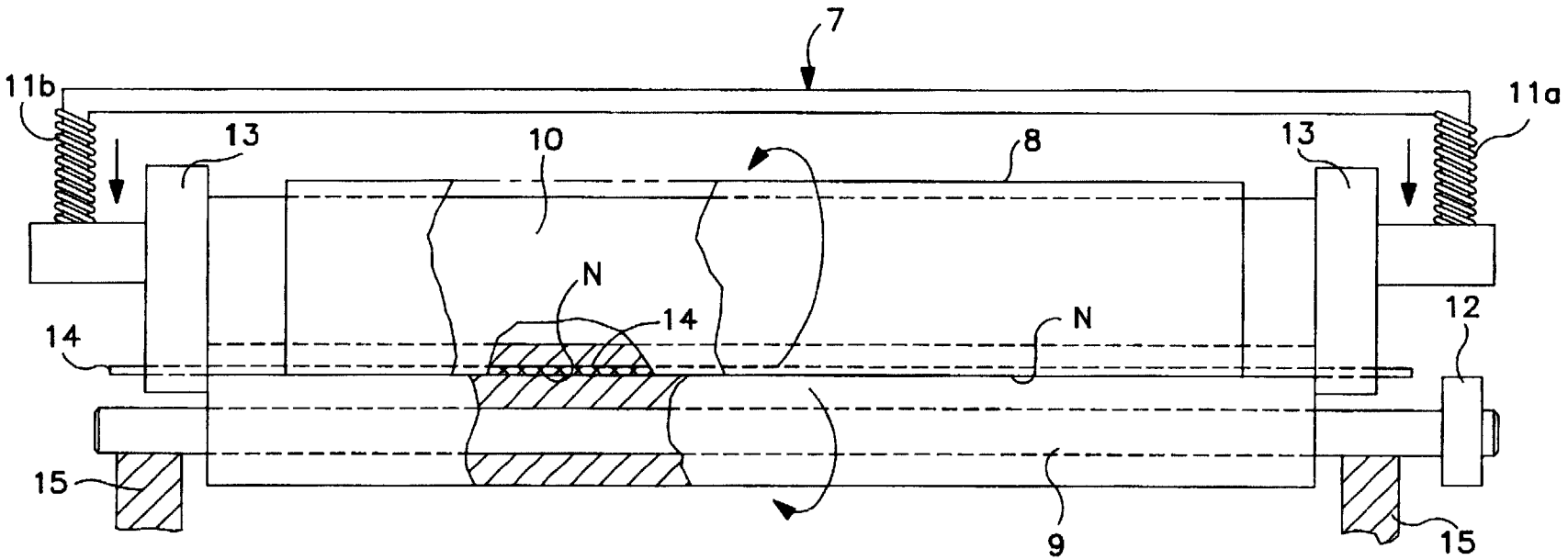
FIG. 2 is a partly broken front view of a heating apparatus according to a first embodiment of the present invention.
Figure 3:
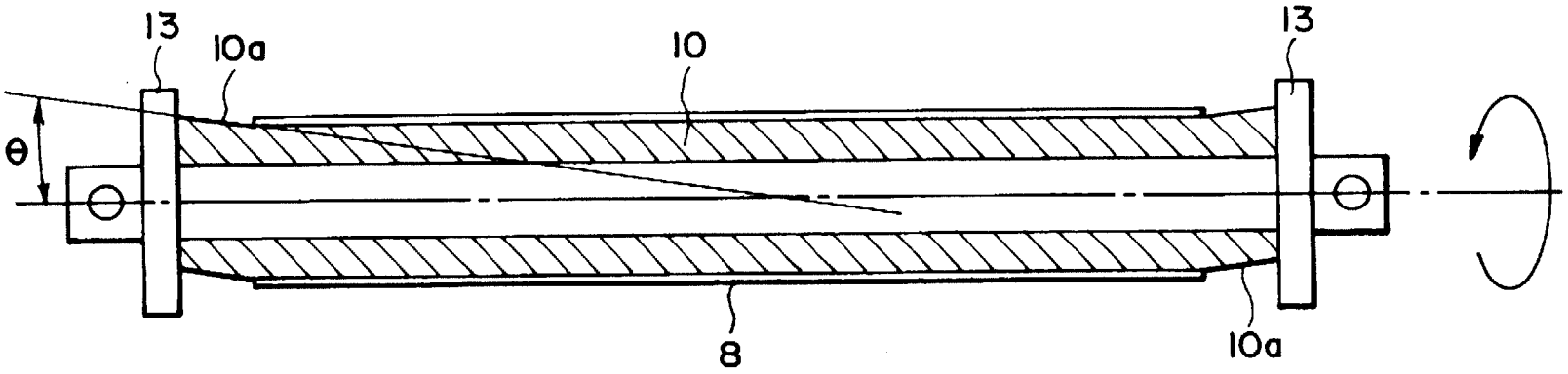
FIG. 3 is a longitudinal top plan view of a fixing film guide used in the apparatus of FIG. 2.

FIGS. 2 and 3 are a front and top plan view, respectively, of a heat fixing device 7 of this embodiment and a longitudinal sectional view of a fixing film guide of this embodiment. The fixing film 8 is in the form of a single layer fixing film having a heat resistivity, toner releasing property and toughness, or a multi-layer film having been treated for a desired surface treatment or for laminating treatment. For example, it is a single layer film of polyester (PET) or polyimide (PI) having approx. 50 micron-thickness and having been treated for heat resistivity, or a multi-layer film comprising the above-described film and a parting layer of tetrafluoroethylene (PTFE) resin. In the fixing device 7, the fixing film is in the form of an endless cylinder, and no tension is applied in the circumferential direction, except for the nip. It is rotated only by the friction with the pressing roller 9.

The pressing roller 9 and a heater 14 contacted to the fixing film guide 10 for supporting the fixing film 8 in the entire longitudinal range, are press-contacted with each other with the fixing film 8 sandwiched therebetween, by pressing springs 11*a* and 11*b* at a predetermined contact pressure (total pressure of 3–6 kg in a width of A4 size, for example). The surface of the heater 14 is provided with a thin film heat generating resistor in the form of a line or stripe. It is made of $TaSiO_2$, silver-palladium, $Ta_2N$, $RuO_2$, nickel-chrome or the like, and is formed through evaporation, sputtering, CVD, screen printing or the like. A lateral end of the fixing film 8 is limited by a flange 13 mounted to the fixing film guide 10 during the manufacturing process, so that the lateral shift of the fixing film 8 occurring when the heat fixing device 7 is operated, is limited.

The transfer sheet P is introduced into a fixing nip together with the fixing film 8 by the surface friction with the pressing roller 9 rotated by a driving gear 12, and thereafter, at least in the fixing nip, it is advanced in the same direction and at the same speed as the pressing roller 9 without slippage between the fixing film 8 and the transfer sheet P by the contact-pressure of the springs 11*a* and 11*b*. The pressing roller 9 is supported by bearings 15. After passing through the fixing nip, the fixing film 8 and the transfer sheet P are advanced together because of the adhesive force of the toner T fused and softened. This step is used as a cooling step, so that the heat of the softened or fused toner T is irradiated, so that the toner T is cooled and solidified, and therefore, a permanent fixed image is formed on the transfer sheet P. After the cooling step, the fixing film 8 and the transfer sheet P are separated easily from each other because the toner is cooled and solidified. After the separation, the transfer sheet P is discharged from the heating apparatus 7.

A longitudinal length of a fixing film supporting surface 10*a* of the film guide for supporting the entire longitudinal length of the internal surface of the fixing film 8, is longer than the width of the fixing film 8. As shown in FIG. 3, in the initial state supporting the fixing film 8, a portion not supporting the fixing film 8 at the opposite ends of the fixing film supporting surface 10*a* makes an angle θ with respect to the central axis of the pressing roller 9 in a direction toward the upstream with respect to the fixing film moving direction at the fixing nip N. The angle θ is larger than 0 and smaller than 90 degrees.

Figure 4:
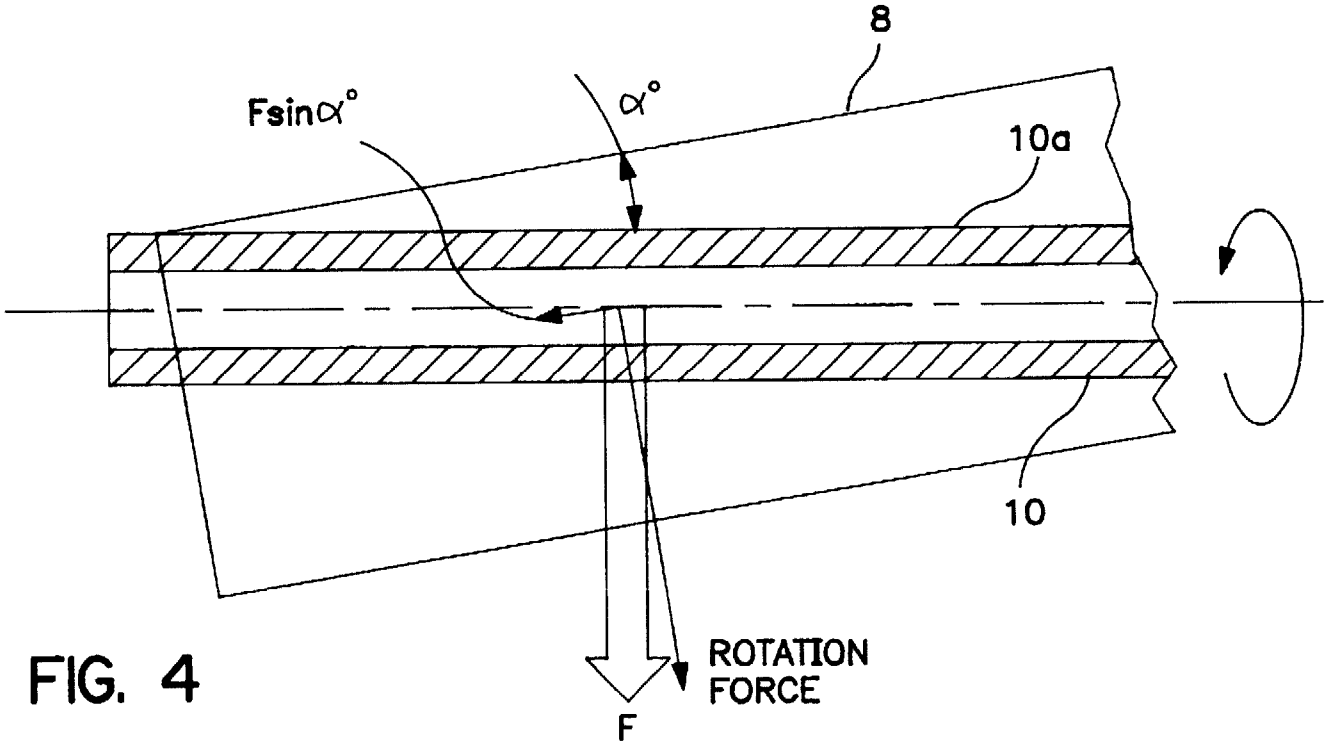
FIG. 4 illustrates occurrence of a film lateral shifting force.

FIG. 4 is a top plan view illustrating occurrence of the lateral shifting force for the fixing film 8. The fixing film laterally shifts in the case that the position or manufacturing accuracy of various members (particularly heater or pressing roller) is not enough, that the temperature distribution or non-uniformity occurs in the direction of the length of the heater. This is because then the conveying force for the fixing film 8 is not uniform in the longitudinal direction. The same occurs in the case that the manufacturing accuracy of the fixing film (film thickness, cylindricity or the like) is not enough. The state of the lateral shifting of the fixing film is, however, uniform, that is as shown in FIG. 4. The conveying force difference for the fixing film attributable to the above-described factor or factors, inclines the central axis of the fixing film by a degrees with respect to the fixing film supporting surface 10*a* and the flange 13 depending on the degree of the difference between the internal peripheral length of the fixing film and the peripheral length of the fixing film guide. By the force F (friction force) perpendicular to the longitudinal direction of the pressing roller 9, the fixing film 8 tends to shift laterally with the force F sina degree.

However, in this embodiment, the opposite end portions of the fixing film supporting surface have the configuration as shown in FIG. 3. This structure provides the following advantageous effects.

Since the configurations of the opposite end portions of the fixing film supporting surface 10*a* of the fixing film guide 10 for supporting the inside surface of the fixing film 8 along the entire longitudinal length, is inclined by an angle θ ($0<\theta<90$ degrees) from a central axis of the pressing roller 9 toward upstream with respect to the fixing film movement direction at the fixing nip N, then the angle a between the central shaft of the fixing film and the fixing film supporting surface 10*a* is limited, and the lateral shifting force for the fixing film 8 is reduced. Therefore, the folding, crack or crease of the fixing film end portion can be avoided, thus stabilizing the fixing film travel, and therefore, reducing the improper image fixing.

Burs, notch or the like produced at the time of cutting the film end, has been strictly controlled. However, since the lateral shifting force can be reduced according to this invention, the requirements to the burs, notches or other manufacturing defects, can be eased, and therefore, the manufacturing cost can be decreased.

Figure 5:
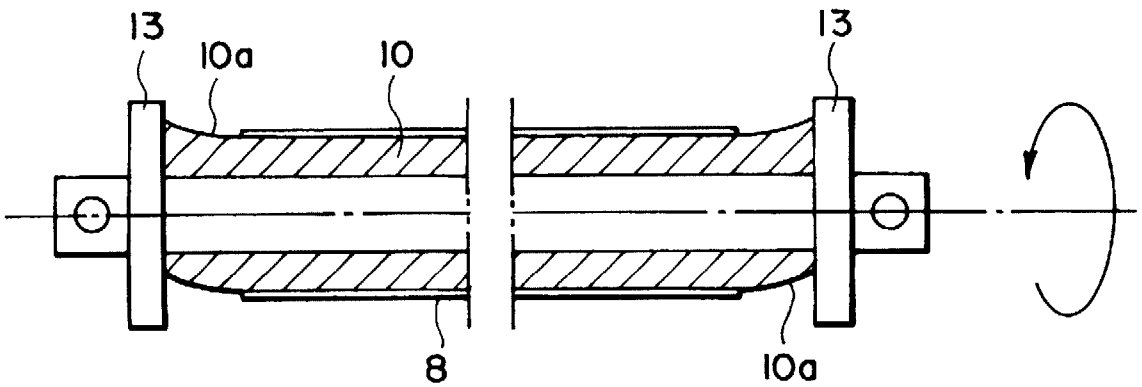
FIG. 5 is a longitudinal top plan view of a fixing film guide for a heating apparatus according to a second embodiment of the present invention, in which an intermediate part is omitted for simplicity.

Referring to FIG. 5, there is shown a fixing film guide 10 according to a second embodiment of the present invention in a longitudinal sectional view in which the longitudinally central portion is omitted for simplicity. In this embodiment, the angle formed between the center axis of the pressing roller 9 and the end portions of the fixing film supporting surface 10*a* toward the upstream of the fixing film movement direction at the fixing nip N is not constant, but increases toward the end. In this embodiment, by the angle a between the fixing film center axis and the fixing film supporting surface 10*a*, the same advantageous effects as in the first embodiment, can be provided.

Figure 6:
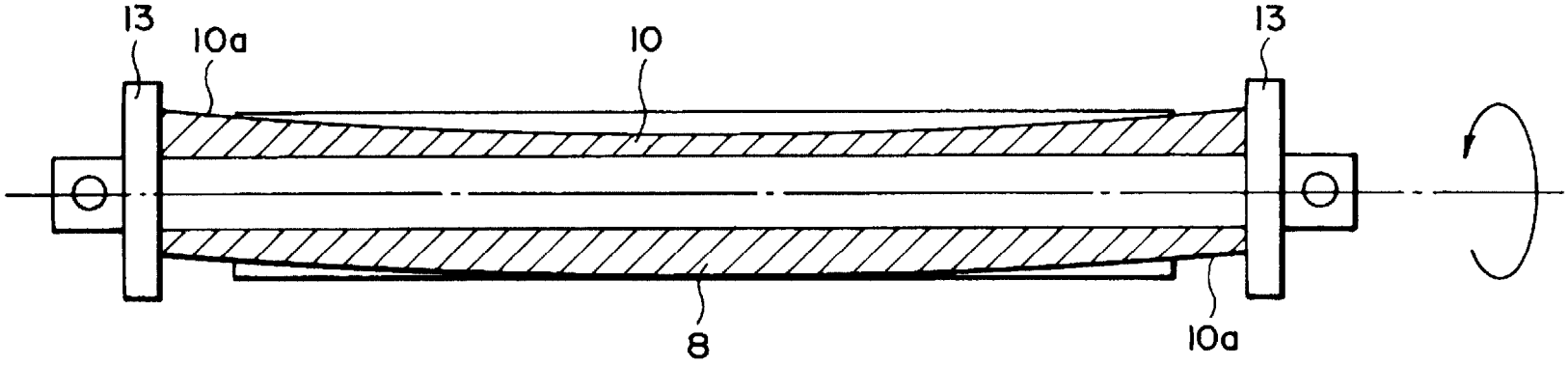
FIG. 6 is a longitudinal top plan view of a fixing film guide of a heating apparatus according to a third embodiment of the present invention.

FIG. 6 is a longitudinal sectional view of a fixing film guide 10 according to a third embodiment of the present invention. In the foregoing first and second embodiments, the angle between the fixing roller 9 axis and the film supporting surface 10*a* at the end portions of the fixing film supporting surface 10*a*, form an angle toward the upstream with respect to the fixing film movement direction at the fixing nip N. In this embodiment, the angle increases from the longitudinal central portion of the fixing film supporting surface 10*a* toward the end portion. The fixing film supporting surface 10*a* is configurated to accomplish this.

In this embodiment, by limiting the angle α between the center axis of the fixing film and the fixing film supporting surface 10*a*, the same advantageous effects as in the first embodiment, can be provided. In this embodiment, the angle formed between the fixing film supporting surface and the center axis of the pressing roller may be constant within the range of 0–90 degrees. The same advantageous effects as in the first embodiment, can be provided.

Figure 7:
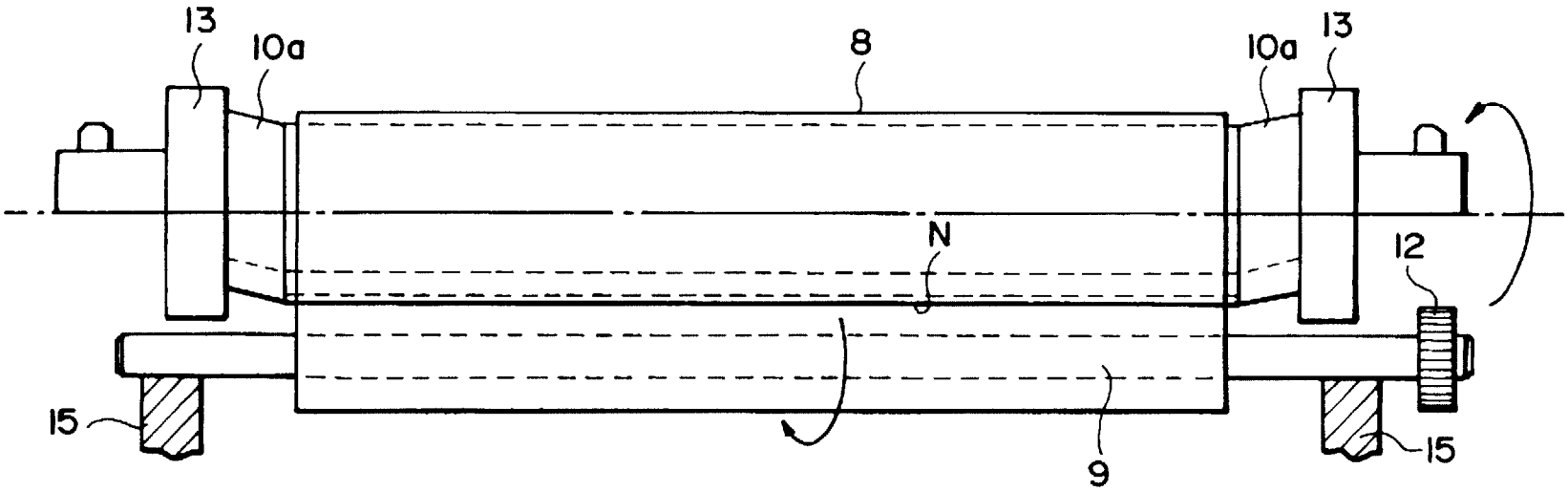
FIG. 7 is a front view of a fixing film guide of a heating apparatus according to a fourth embodiment of the present invention.

Referring to FIG. 7, there is shown a fixing film guide 10 of a third embodiment in a front view. In the foregoing first and second embodiments, the angle between the fixing film supporting surface 10*a* and the center axis of the pressing roller 9 at the end portions of the fixing film supporting surface 10 is formed toward the upstream of the fixing nip N, with respect to the fixing film movement direction. In this embodiment, the angle formed between the fixing film supporting surface 10*a* and the pressing roller 9 adjacent the end portions, is toward the fixing film guide 10 in the direction perpendicular to the fixing nip N.

In this embodiment, the angle formed between the center axis of the pressing roller 9 and the fixing film supporting surface 10*a* at the opposite end portions, is formed toward the fixing film guide in a direction perpendicular to the nip. By doing so, when the fixing film 8 is laterally shifted, the friction against the sliding motion between the inside surface of the fixing film and the fixing film supporting surface 10*a* increases thus removing the non-uniformity of the conveying force distribution in the longitudinal direction of the fixing film, so that the lateral shifting force of the fixing film 8 is reduced, by which, the same advantageous effect as in the first embodiment can be provided.

Figure 8:
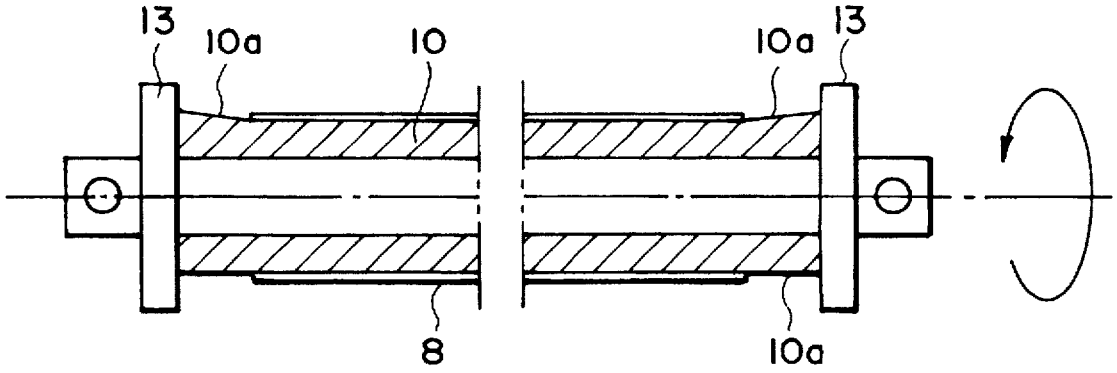
FIG. 8 is a longitudinal top plan view of a fixing film guide used in a heating apparatus according to a fifth embodiment of the present invention, in which an intermediate part is omitted.

Referring to FIG. 8, there is shown a fixing film guide 10 according to a fifth embodiment of the present invention, in which the longitudinally central portion is omitted for simplicity. In this embodiment, the end portions of the fixing film supporting surface 10*a* are tapered at an upstream side of the fixing nip N in the fixing film movement direction.

Figure 9:
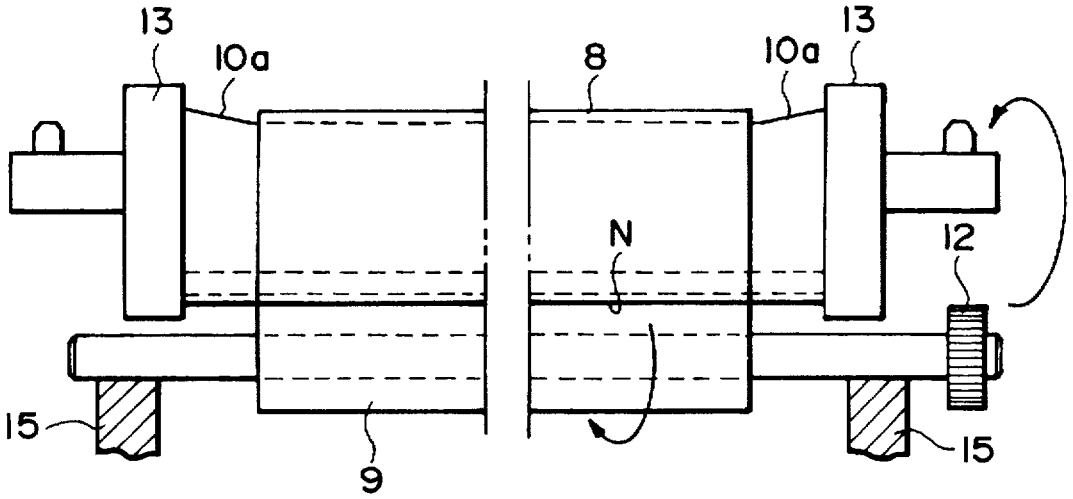
FIG. 9 is a front view of a fixing film guide of a heating apparatus according to a sixth embodiment of the present invention, in which an intermediate part is omitted.
Figure 10:
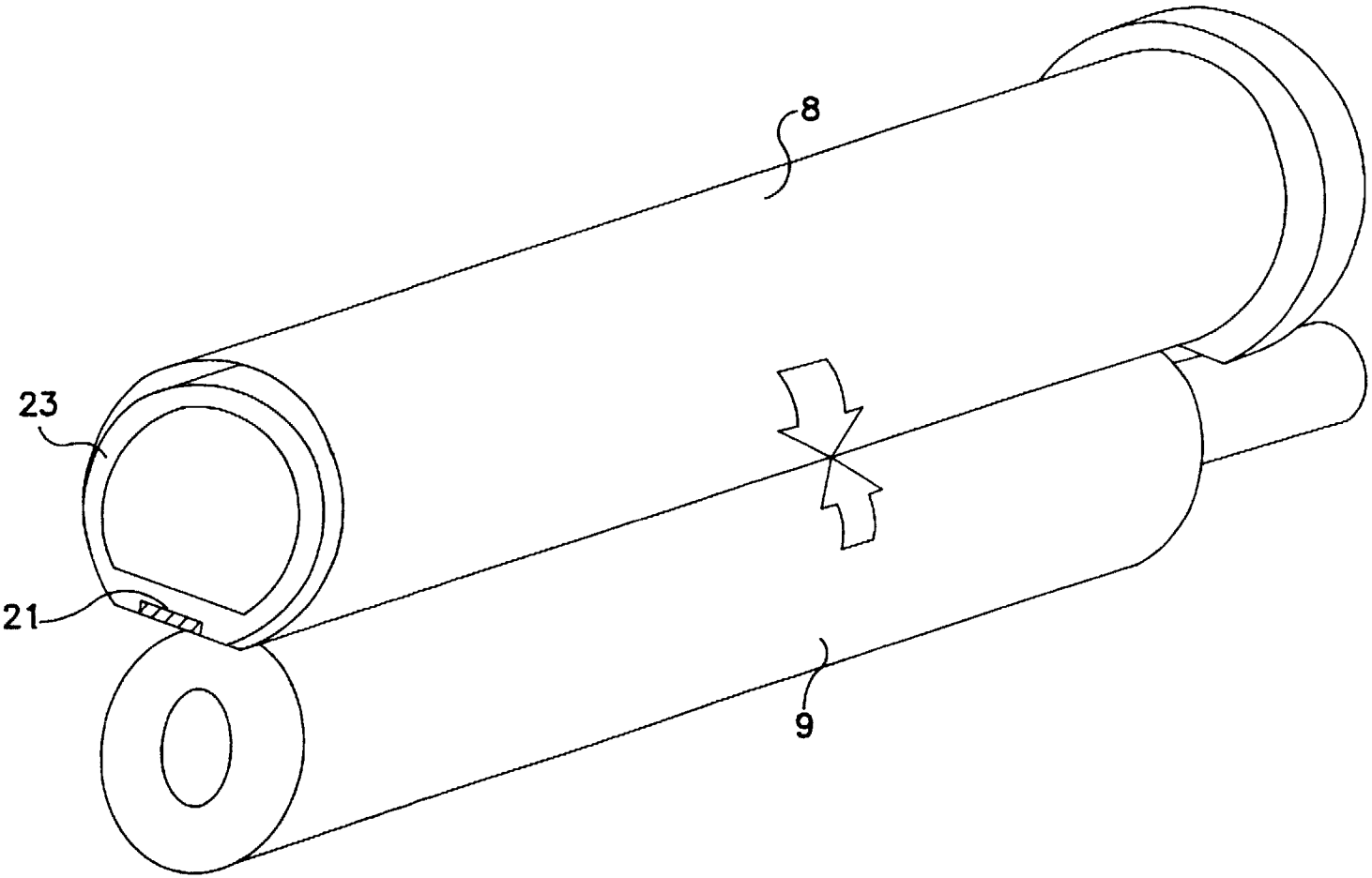
FIG. 10 is a perspective view of an example of a heating apparatus using a tensionless type film.
Figure 11:
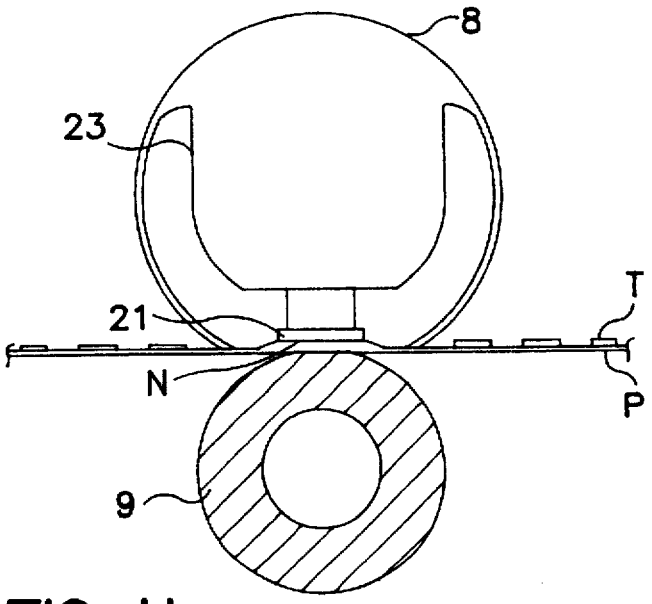
FIGS. 11 and 12 are sectional views of a tensionless film type heating apparatus.
Figure 12:
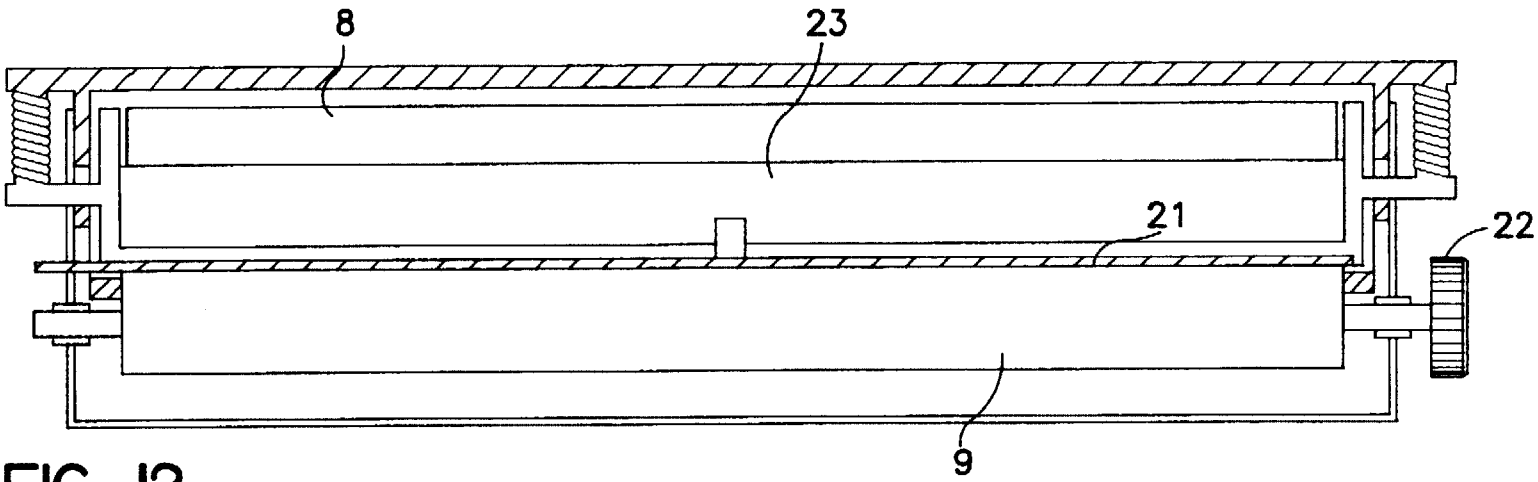

With the lateral shifting of the fixing film 8 toward a lateral end, the gap between the fixing film 8 and the fixing film supporting surface 10*a* decreases, so that the angle a formed between the center axis of the fixing film and the fixing film supporting surface 10*a* is reduced, and the resistance against the sliding motion between the inside surface of the fixing film and the supporting surface 10*a* for the fixing film, is increased, so that the non-uniform conveying force distribution in the longitudinal direction of the fixing film 8 is reduced, by which the lateral shifting force for the fixing film 8 can be reduced. Therefore, the same advantageous effects as in the first embodiment, can be provided. FIG. 9 is a modification of the fifth embodiment, in which the tapered configuration at the opposite end portions of the fixing film supporting surface 10*a* are provided at the fixing film guide 10 side in the direction perpendicular to the fixing nip.

In this embodiment, the gap between the fixing film 8 and the fixing film supporting surface 10*a* decreases with motion of the fixing film 8 toward a lateral end, so that the angle a between the fixing film central axis and the fixing film supporting surface 10*a* is reduced, and the resistance against the sliding motion between the inside surface of the fixing film and the fixing film supporting surface 10*a* increases, so that the non-uniformity of the advancing force distribution in the longitudinal direction of the fixing film 8 is reduced, by which the lateral shifting force for the fixing film 8 is reduced. Therefore, the same advantageous effects as in the first embodiment can be provided.

As described hereinbefore, the heating apparatus according to embodiments 1–6 of this invention has a configuration of the fixing film supporting surface of the fixing film guide, that is, the deformed configuration so that the lateral shifting force applied to the fixing film is reduced, thus minimizing the possibility of folding the end portion of the fixing film, cracking or creasing. Therefore, the travel of the fixing film is stabilized, and the improper image production can be avoided with long service life of the apparatus.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus comprising:

a heater;

an endless film having a substantially equal diameter along its entire length, said film being in sliding contact with said heater at its inside surface;

a pressing roller cooperative with said heater to form a nip with said film extending therebetween, said pressing roller being rotatable to move said film;

regulating means for abutment by an edge of said film to regulate lateral shifting of said film; and a guiding member, extending in a direction substantially perpendicular to a movement direction of the film, for guiding an inside surface of said film, said film being loosely extended around said guiding member, said guiding member being provided at an end thereof with a film guiding surface inclined relative to an axis of said pressing roller.

2. An apparatus according to claim 1, wherein an angle formed between said film guiding surface and the center axis of said pressing roller, increases toward an end of said guiding member.

3. An apparatus according to claim 1, wherein a difference between an internal peripheral length of said film and an external peripheral length of said guiding member decreases toward an end of said guiding member.

4. An apparatus according to claim 1, wherein the film guiding surface inclined relative to the central axis of said pressing roller is provided at each of the end portions of said guiding member.

5. An apparatus according to claim 1, wherein said inclined film guiding surface is inclined toward upstream with respect to a movement direction of said film at said nip.

6. An apparatus according to claim 5, wherein said inclined film guiding surface is formed at an upstream side of said guiding member in the movement direction.

7. An apparatus according to claim 5, wherein a plurality of such inclined surfaces are provided, one of which is formed at an upstream side of said guiding member and another one of which is provided at a downstream side of said guiding member.

8. An apparatus according to claim 1, wherein said inclined film guiding surface is inclined toward said film.

9. An image heating apparatus comprising:

a heater;

an endless film having a substantially equal diameter along its entire length, said film being in sliding contact with said heater at its inside surface;

a pressing roller cooperative with said heater to form a nip with said film extending therebetween, said pressing roller being rotatable to move said film; and a guiding member, extending in a direction substantially perpendicular to a movement direction of the film, for guiding an inside surface of said film, said film being loosely extended around said guiding member, said guiding member being provided at an end thereof with a film guiding surface inclined relative to an axis of said pressing roller, wherein said inclined film guiding surface is formed at an end of said guiding member and at each of upstream and downstream sides of said guiding member with respect to a movement direction of said film at said nip, and the inclined surfaces are inclined toward upstream in the movement direction.

10. An apparatus according to claim 9, wherein said inclined film guiding surface is provided at each of the end portions of said guiding member.

* * * * *